US009784004B2

(12) United States Patent
Ervin et al.

(10) Patent No.: US 9,784,004 B2
(45) Date of Patent: Oct. 10, 2017

(54) FIBER REINFORCED ANCHORS AND CONNECTORS, METHODS OF MAKING ANCHORS AND CONNECTORS, AND PROCESSES FOR REINFORCING A STRUCTURE

(71) Applicant: Kulstoff Composite Products, LLC, Austin, TX (US)

(72) Inventors: Timothy R. Ervin, Napa, CA (US); Christopher R. Lewis, Austin, TX (US); Ravindra V. Kanitkar, Mountain View, CA (US)

(73) Assignee: KULSTOFF COMPOSITE PRODUCTS, LLC, Austin, TX (US)

( * ) Notice: Subject to any disclaimer, the term of this patent is extended or adjusted under 35 U.S.C. 154(b) by 0 days.

(21) Appl. No.: 14/829,588

(22) Filed: Aug. 18, 2015

(65) Prior Publication Data

US 2016/0053503 A1 Feb. 25, 2016

Related U.S. Application Data

(60) Provisional application No. 62/039,239, filed on Aug. 19, 2014.

(51) Int. Cl.
*E04G 23/00* (2006.01)
*E04G 23/02* (2006.01)

(52) U.S. Cl.
CPC .. *E04G 23/0218* (2013.01); *E04G 2023/0262* (2013.01)

(58) Field of Classification Search
CPC ..... B05D 3/02; B05D 3/12; E04C 2/22; E04C 2/38; E04C 5/00; E04C 5/16; E04C 5/073; E04C 5/12; E04G 23/0218; E04G 23/0203; E04G 23/0222; E04G 23/02; E04B 1/00; E04B 2/00; E04B 1/38; B05C 11/023
USPC .... 427/207.1, 256, 389.9, 394; 118/56, 419, 118/423, 424
See application file for complete search history.

(56) References Cited

U.S. PATENT DOCUMENTS 4,648,224 A 3/1987 Kitta et al.
5,580,642 A 12/1996 Okamoto et al.
5,937,606 A * 8/1999 Meier ..... E04G 23/0218 52/415

(Continued)

*Primary Examiner* — Beth Stephan
(74) *Attorney, Agent, or Firm* — Oliff PLC

(57) ABSTRACT

A method of anchoring surface mounted strengthening systems to a structural member being repaired/strengthened or connecting the surface mounted strengthening systems to adjacent structural members to provide force-transfer or terminating a surface-mounted strengthening system includes drilling a hole in an existing structural member and inserting a portion of a fiber-reinforced anchor or connector into the hole in the existing structural member. The anchor or connector includes a bundle of fibers/rovings, and the portion includes rovings encapsulated in a pre-cured adhesive to form a reinforced portion having a desired cross-sectional size and shape to be received by the hole. The method further includes splaying free ends of the fibers/rovings at an end of the anchor and adhering the splayed ends of the fibers/rovings onto the surface-mounted strengthening system of the strengthened member or onto adjacent members with adhesive.

25 Claims, 7 Drawing Sheets

(56) References Cited

U.S. PATENT DOCUMENTS 6,389,775 B1 * 5/2002 Steiner ..... E04G 23/0218 52/293.2
6,418,684 B1 * 7/2002 Morton ..... E04G 23/0218 52/293.2
6,511,727 B1 * 1/2003 Bleibler ..... E04C 5/07 264/285
7,207,149 B2 * 4/2007 Fyfe ..... E02D 27/42 156/73.2
7,574,840 B1 8/2009 Fyfe
7,930,863 B1 4/2011 Fyfe
7,946,088 B1 * 5/2011 Fyfe ..... E04G 23/0218 52/309.13
7,980,033 B1 7/2011 Fyfe
8,496,404 B1 7/2013 Fyfe
8,511,043 B2 8/2013 Fyfe
8,713,891 B2 5/2014 Carr et al.
8,784,006 B2 7/2014 Fyfe
8,795,832 B2 8/2014 Fyfe et al.
2005/0241260 A1 * 11/2005 Wheatley ..... E04G 23/0218 52/719
2009/0013625 A1 * 1/2009 Tourneur ..... E04G 23/0218 52/223.13
2009/0044476 A1 * 2/2009 Agneloni ..... E04G 23/0218 52/443
2009/0211194 A1 8/2009 Fyfe et al.
2011/0036029 A1 2/2011 Tourneur et al.
2011/0219710 A1 * 9/2011 Fyfe ..... E02D 5/226 52/167.1
2012/0047841 A1 * 3/2012 Fyfe ..... E02D 27/42 52/695
2012/0110940 A1 * 5/2012 Hemphill ..... E04G 23/0218 52/514

* cited by examiner

FIBER REINFORCED ANCHORS AND CONNECTORS, METHODS OF MAKING ANCHORS AND CONNECTORS, AND PROCESSES FOR REINFORCING A STRUCTURE

TECHNICAL FIELD

The present disclosure relates generally to anchors and connectors, for example, fiber-reinforced anchors and connectors, for reinforcing a structure and, more particularly, to methods of making anchors and connectors and processes for reinforcing a structure using the anchors and connectors.

BACKGROUND

The stock of existing infrastructure (including buildings, bridges, tunnels, tanks, pipes, support structures in industrial facilities) is enormous. Financial and operational pressures necessitate that such infrastructure be continually maintained. Such maintenance often involves repair and strengthening of such structures or their individual members. In the past two decades surface mounted reinforcements have gained widespread acceptance for such repair and strengthening. These surface mounted reinforcing materials include, but are not limited to, fiber reinforced polymers (FRP), fiber reinforced cementitious matrices, fiber reinforced coatings as well as prefabricated panels utilizing a variety of materials.

Typically such surface mounted reinforcements are attached to existing structural surfaces by adhesion. The adhesives can include epoxies, vinyl esters, phenolic materials, cementitious materials etc. It is well understood that such surface mounted reinforcements can debond from the structural surfaces when the strains in the reinforcement material reach some threshold values. Such debonding failures are often sudden and catastrophic. In addition, such debonding failures occur at strength or strain values far below the available strength/strain of such surface mounted reinforcing materials, thus resulting in under-utilization of the full potential of such materials. Research has also demonstrated that such debonding failures can be mitigated or delayed by the use of anchors which tie the surface mounted reinforcements deeper into the structural members rather than relying on surface adhesion only. As such, several different types of anchors are currently being used in the industry. These anchors typically comprise raw fiber/rovings which are installed in drilled holes filled with adhesive and the free ends of the anchors are splayed onto the surface of the structural members.

For example, with reference to U.S. Pat. No. 7,574,840, a connector includes a roving, a borehole that pierces a first beam, backfill, and an adhesive. The roving is composed of a loosely twisted length of flexible filaments. The roving is inserted into a borehole with free ends of the roving protruding from borehole openings. A middle portion of the roving is disposed in the borehole. Backfill is added to the borehole to anchor the roving within the borehole. The backfill fluid fills the borehole and prevents the idle portion from being removed from the borehole. The two free ends of the roving are splayed so that the loose filaments are substantially separate. The splayed filaments are then attached to outer surfaces by an adhesive.

In another conventional application, as described in U.S. Patent Application Publication No. 2011/0036029, a construction reinforcement rod includes a polymer matrix of a reinforcement of elongated shape in lamellar form. The reinforcement matrix is introduced into a furnace, brought to a temperature suitable for leading to the pyrolysis of the polymer matrix of the reinforcement. After the polymer matrix is removed, the fibers/rovings are rearranged in a fan-like configuration.

The current state of practice vis-à-vis such anchors and connectors has several limitations:

1. Where the anchors are supplied by a manufacturer, the installer has to work with easily damageable fibers and rovings.

2. In many cases, the installers make their own anchors from rovings or folded woven FRP supplied by manufacturers in which case there can be considerable variability in the field-production of such anchors.

3. These flexible anchors, composed of rovings, are then installed into drilled holes filled with adhesive. Often a tool has to be used to insert the anchors into the adhesive-filled drilled holes. Since the rovings and fibers are flexible, there is no visual or other verification that the anchors have reached the required embedment depth or that they are not damaged in any way in the holes. After repeated use, the tools become very sticky and can pull the fibers/rovings out of the hole. This requires introducing possible hazardous chemicals to clean the tool and maintain the work quality.

4. Often engineering plans will call out either a diameter for the anchors or the diameter of the drilled hole within which these anchors are to be installed. In the first instance, since the anchors are composed of flexible fibers or rovings, it is very difficult for inspectors on the construction site to verify the anchor diameter per the plans. In the second instance it is impossible to verify if the anchors have the correct number of fibers/rovings to provide the required structural strength.

5. In some instances, engineering plans will actually provide a required strength that the anchors have to provide. In this case it is very difficult for installers or inspectors to know the rating for such anchors when they are ready to be installed in the field.

Therefore, it may be desirable to provide factory fabricated anchors and connectors with preformed and pre-cured reinforced portions for ease of diameter and/or length measurement. It may be desirable to provide anchors and connectors having a predetermined number of fibers or rovings based on design and testing to achieve certain capacity ratings. It may be desirable to provide preformed and pre-marked reinforced ends or midsections for ease of verification in the field, ease of installation (e.g., no or minimal tools required), and ease of verification of depth of embedment via marked lines. It may be desirable to provide anchors and connectors having listed anchor strengths with testing backup and/or complete reliability from design to manufacture to installation. It may be desirable to provide anchors and connectors installable via installation techniques similar to those for metallic anchors, which are conventionally used extensively in the industry, so as to create consistency and reduce errors in the field. It may be desirable to provide anchors and connectors with material traceability and/or delivered in clearly-labeled containers showing anchor type and, in some aspects, cross-linked with plans showing installation locations.

SUMMARY

According to various aspects of the disclosure, ready to use fiber reinforced anchors and connectors are conventionally used to enhance bond/attachment for and to create continuity of surface mounted repair and strengthening systems in building and other structures. Anchors and connectors consist of fibers/rovings, which in turn are composed of filaments, and adhesives.

Anchors are inserted into holes drilled in existing structural members and are used to anchor surface mounted strengthening systems to the structural member being repaired/strengthened or to connect the surface mounted strengthening systems to adjacent structural members to provide force-transfer or to terminate a surface mounted strengthening system. Anchors are shop fabricated with one end preformed to the required diameter and length and fiber/roving count. The preformed end can have integrated surface deformation or roughness to enhance and promote adhesion of the embedded end of the anchor in the drilled hole. The other end of the anchor has free ends of fibers/rovings such that the filaments can be distributed or splayed, and adhered with adhesive, onto a surface of a structure strengthening system of the strengthened member or onto adjacent members.

Connectors are used to create continuity of the surface mounted strengthening systems across other structural members so as to provide force-transfer and other benefits. Connectors are shop fabricated with the middle portion preformed to the correct diameter and length and fiber/roving count. The two ends have free fibers/rovings such that the filaments can be distributed or splayed, and adhered with adhesive, onto the surface-mounted strengthening system of the strengthened member or onto adjacent members.

The anchors provide significantly higher bond/adhesion of the surface mounted reinforcement to the structure resulting in greater strength capacity and higher utilization of the surface-mounted reinforcement. The anchors also provide for the transfer of forces between the structure and the structural member being repaired or strengthened. The anchors also delay failure of the structural system at higher loads. The anchors and connectors enable an increase in structural ductility and resistance to forces.

According to some aspects of the disclosure, a method of saturating a bundle of fibers/rovings includes providing a tray configured to hold a volume of liquid, wherein the tray includes at least one dowel spaced from a bottom of the tray and extending transverse across the longitudinal direction of the tray. The method further includes feeding the bundle of fibers/rovings under at least one dowel in the transverse direction.

In some aspects, the bundle of fibers/rovings are fed along a surface of the first end wall that slopes from a top of the tray toward the bottom of the tray before feeding the bundle of fibers/rovings under the dowel, and then, after being fed under the dowel, the bundle of fibers/rovings are fed along a surface of the second end wall that inclines from the bottom of the tray toward the top of the tray.

In accordance with various aspects, the tray may be provided with a first dowel and a second dowel, wherein the first dowel is spaced further from the bottom of the tray than the second dowel, allowing the fibers/rovings to spread, and the bundle of fibers/rovings are fed under the first dowel before being fed under the second dowel that begins the removal of excess adhesive.

In some embodiments, after the bundle of fibers/rovings is fed under at least one dowel, the bundle of fibers/rovings is fed through a stripping member configured to remove excess adhesive from the bundle of fibers/rovings. Before the bundle of fibers/rovings are fed through the stripping member, the stripping member is engaged with a cutout at the second end of the tray such that the stripping member is prevented from moving relative to the second end of the tray while the bundle of fibers/rovings are fed through the stripping member.

Further advantages and embodiments may be apparent from the appended drawings.

DETAILED DESCRIPTION

Figure 1A:
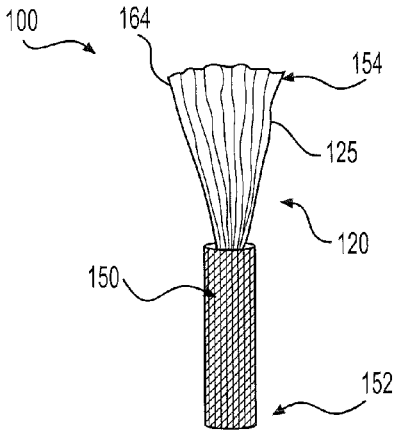
FIGS. 1A-1D show diagrammatic representations of exemplary anchors and connectors in accordance with various aspects of the disclosure.

FIGS. 1A-1D illustrate various exemplary anchor 100 and connector 100' configurations. The anchors/connectors 100, 100' include a bundle 120 of fibers/rovings 125. The bundle 120 comprises loose lengths of flexible fibers/rovings 125. The fibers/rovings 125 are all generally the same length and are arranged together so that the bundle 120 is approximately the same length as the fibers/rovings 125. The fibers/rovings 125 can be filaments made of any material including, but not limited to, carbon, glass, basalt, steel, graphite, nylon, aramid, high-modulus polyethylene, ceramic, quartz, PBO, fullerene, LCP, or other synthetic or organic/natural material that can be manufactured in long fibers/rovings.

In some exemplary embodiments an anchor 100 or a connector 100' may include, but is not limited to, 400,000 to 5,000,000 fibers. Of course, an anchor 100 or a connector 100' may include more than 5,000,000 fibers or less than 400,000 fibers, as dictated by the application. In some exemplary embodiments, a roving may include, but is not limited to, 3000-48,000 fibers. Of course, a roving 125 may include more than 48,000 fibers or less than 3000 fibers, as dictated by the application. Further, in some exemplary embodiments, an anchor 100 or a connector 100' may include, but is not limited to, upwards of 200 rovings. Of course, an anchor 100 or a connector 100' may include more or less than 200 rovings, as dictated by the application. It should be appreciated that these numbers are merely exemplary and are in no way intended to limit the embodiments of the disclosure.

Figure 1B:
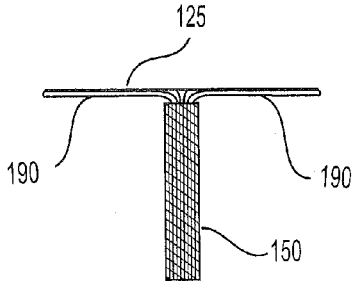
Figure 1C:
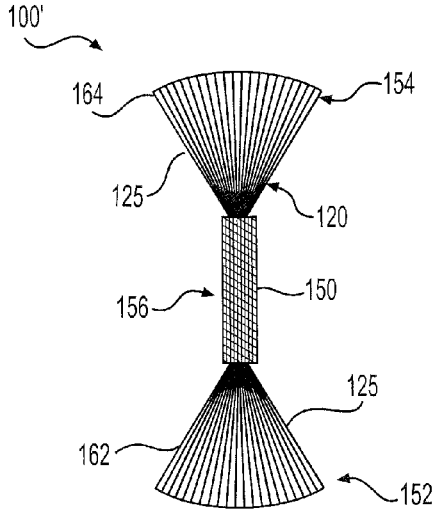
Figure 1D:
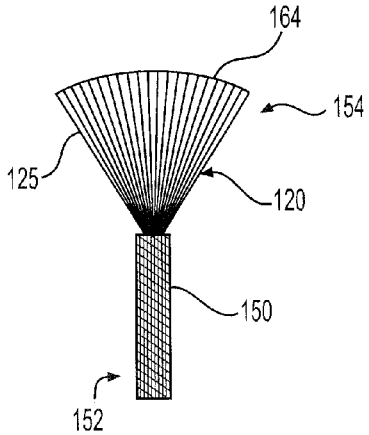

The anchors/connectors 100, 100' include a reinforced portion 150, a first end 152, and a second end 154. The anchors 100 include the reinforced portion 150 at the first end 152 and free ends 164 of the fibers/rovings 125 at the second end 154. The connectors 100' include the reinforced portion 150 at the middle portion 156 of the connectors 100' between the first end 152 and the second end 154. The first end 152 and the second end 154 of the connectors 100' include free ends 162, 164 of the fibers/rovings 125, respectively. Rovings 125 of the one or two free ends 162, 164 can be splayed, or spread apart, such as by pulling and using the hands to apply a force generally perpendicular to the length of the fibers/rovings 120. FIG. 1B illustrates the exemplary anchor 100 with its free ends 164 splayed onto a surface of a structural member 190.

As shown in FIGS. 3A to 4C, anchors 100 are generally inserted into holes drilled in existing structural members 190 and are used to anchor surface mounted strengthening systems 194 to the structural member being repaired/strengthened or to connect the surface mounted strengthening systems 194 to adjacent structural members 190 to provide force-transfer or to terminate a surface-mounted strengthening system. By way of example only, it should be appreciated that the structural members 190 may include, but are not limited to, a slab, a wall, a beam, and/or a column of an existing structure.

The anchors 100 are shop fabricated with the first end 152 precured and formed to the correct length, with the proper fiber/roving count, and cross-section, including but not limited to circular, oval, and rectangular. The first end 152 is inserted into the drilled holes in the existing structural members 190. The second end 154 comprises the loose flexible fibers/rovings 164 of the bundle 120 which extend out of the drilled hole and are distributed or splayed, and adhered with adhesive, onto the surface-mounted reinforcement of the strengthened member or onto adjacent members.

Connectors 100' are used to create continuity of the surface mounted strengthening systems 194 across existing structural members 190 so as to provide force-transfer and other benefits. Connectors 100' are shop fabricated with the middle portion 156 preformed to the correct length, with the proper fiber/roving count, and cross-sectional shape, including but not limited to circular, oval, and rectangular. The two ends 152, 154 have free fibers/rovings 162, 164 of the bundle 120, which extend outside of the structural member through which the connector is installed and are distributed or splayed, and adhered with adhesive, onto the surface-mounted reinforcement 194 of the strengthened member or onto adjacent members 190.

The anchors 100 and connectors 100' will typically be manufactured in a factory/shop. The anchors 100 and connectors 100' are formed by taking a predetermined amount of fibers/rovings 125 having a desired length and bundling the fibers/rovings 125 to a desired cross-sectional size and shape, including circular, oval, and rectangular. The fibers/rovings 125 may be bundled in either a straight length or a bent U-shape form.

Then, in the case of anchors 100, the first end 152 is encapsulated in an adhesive to form a pre-cured and formed reinforced portion 150. In the case of connectors 100', the middle portion 156 is encapsulated in an adhesive to form the pre-cured and formed reinforced portion 150. The pre-cured and formed reinforced portion 150 can have a circular, elliptical or any other shape cross-section. The adhesive can be any appropriate adhesive including, but not limited to, epoxies, vinyl esters, polyesters, phenolics, cementitious materials, etc.

Figure 2A:
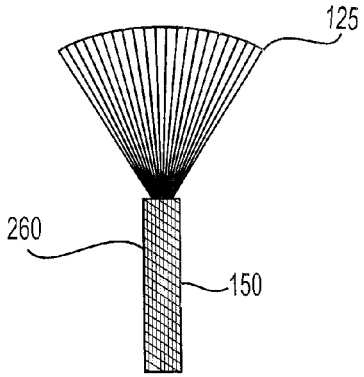
FIGS. 2A-2D show diagrammatic representations of exemplary anchors and connectors in accordance with various aspects of the disclosure.
Figure 2B:
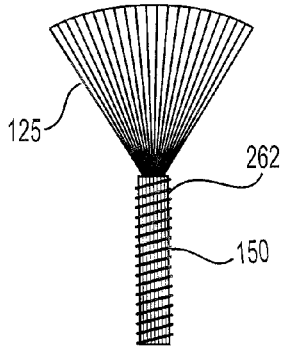

The pre-cured and formed reinforced portion 150 can be cured in a variety of ways, including but not limited to, ambient and/or high-temperature, exposure to UV light or use of specialty curing additives. In various aspects, the pre-cured and formed reinforced portion 150 of the anchors/connectors 100, 100' can be further treated. For example, in some aspects, a granular or particulate material 260 may be introduced or dispersed in the adhesive to create a roughened texture along the reinforced portion 150, as illustrated in FIG. 2A. In some aspects, a helical or spring-like piece 262 may be positioned around the periphery to create ridges and deformations along the reinforced portion 150, as shown in FIG. 2B. In some aspects, a special forming piece or mold may be used to shape the periphery of the reinforced section 150 to have desired deformations.

Figure 2C:
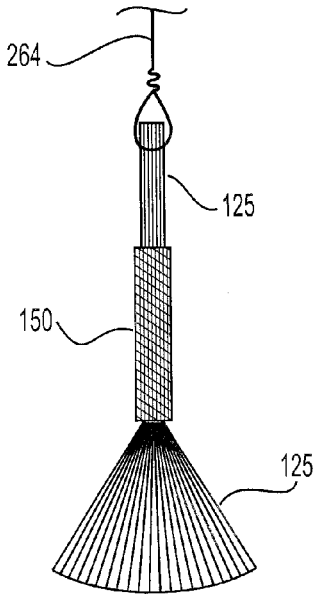
Figure 2D:
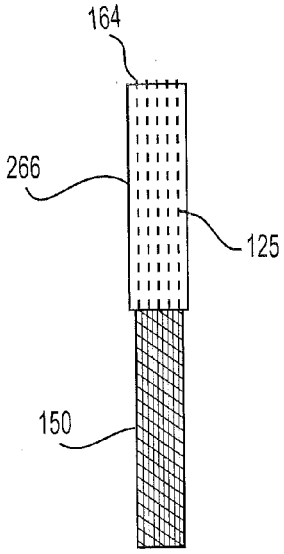
Figure 3A:
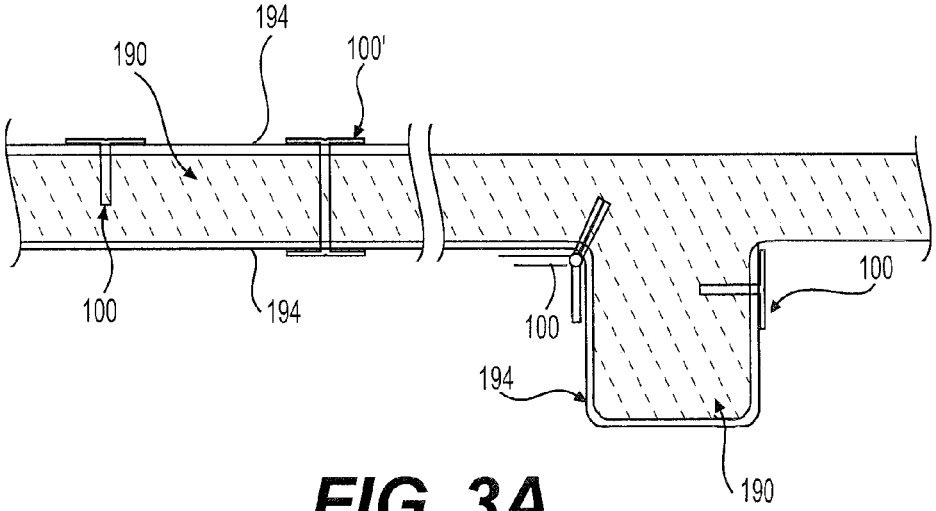
FIG. 3A shows a diagrammatic representations of exemplary applications of exemplary anchors and connectors in accordance with various aspects of the disclosure.
Figure 3B:
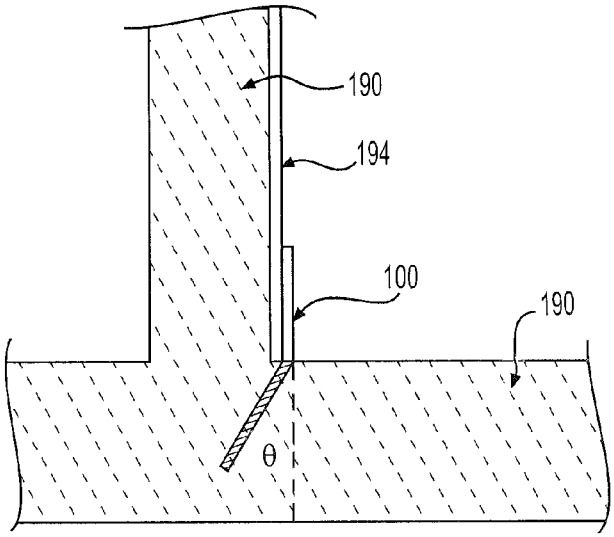
FIG. 3B shows a diagrammatic representations of exemplary applications of exemplary anchors in accordance with various aspects of the disclosure.
Figure 4A:
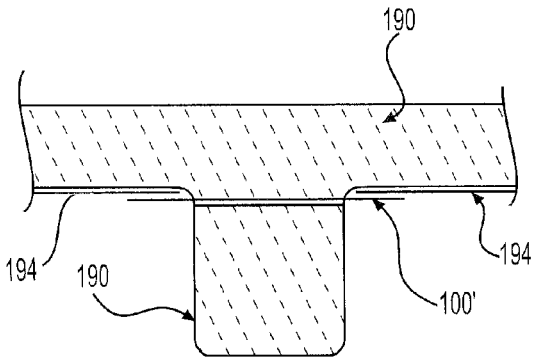
FIGS. 4A-4C show diagrammatic representations of exemplary applications of exemplary connectors in accordance with various aspects of the disclosure.
Figure 4B:
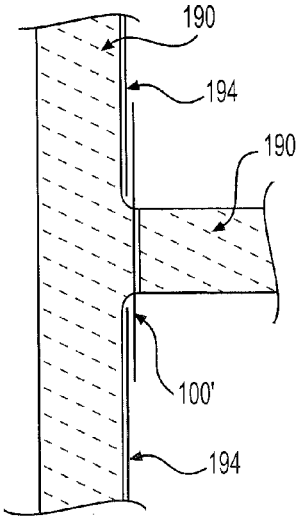
Figure 4C:
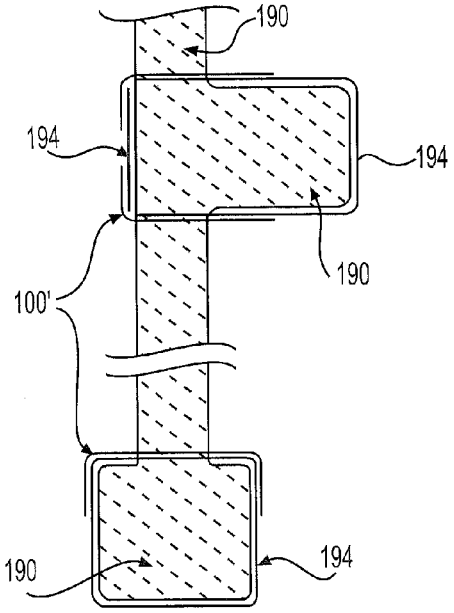

It should be appreciated that the anchors/connectors 100, 100' can be made either by hand wherein each piece is fabricated manually or via the use of molds, which in turn can be either manually or mechanically operated. It should also be appreciated that the anchors 100 and connectors 100' described above may include one or more additional features. For example, as shown in FIG. 2C, a wire 264 may be placed within the formed and pre-cured reinforced portion 150 and extend out as far or in any configuration desired to facilitate the placement of the anchor/connector 100, 100'. In some aspects, as illustrated in FIG. 2D, a form/sleeve 266 may be used to protect one or both free ends 162, 164 of flexible fibers/rovings from damage and serve as an installation aid.

A person skilled in the art would appreciate that specially marked fibers/rovings 125 may be centered in one or both of the flexible filament ends 162, 164 to facilitate accurate splaying of the fibers/rovings 125 onto the structure or surface-mounted reinforcement. Additionally or alternatively, the pre-cured and formed reinforced portion 150 may include special marks indicating embedment depth or mid-length to facilitate the placement of the part. In some aspects, the anchor/connector 100, 100' may include a part number or other designation to facilitate appropriate use in the field and for ease of tracking.

Referring now to FIGS. 3A to 4C, various exemplary applications of exemplary anchors and connectors in accordance with the disclosure are illustrated. For example, anchors may be used to anchor a surface-mounted reinforcement to a structural member being reinforced. In other aspects, an anchor may be used to prevent or delay the process of debonding of the surface-mounted reinforcement from the structural member being reinforced. In some aspects, an anchor may be used to transfer forces between the surface-mounted reinforcement and the structural member being reinforced and/or between the surface-mounted reinforcement and adjacent members. Connectors, on the other hand, may be used to provide continuity of the surface-mounted reinforcement across existing members, transfer forces between the surface-mounted reinforcement where the reinforcement is discontinuous, and/or confine members by providing continuity of surface-mounted reinforcement completely around the member being reinforced.

The anchors described above may be installed by drilling or coring a hole of a predetermined diameter or shape into a structure. The hole size and shape is a function of the size and shape of the anchor. The depth of the hole is based on the strength capacity required. The hole may be cleaned by the use of a wire brush and pressurized air. The number of brush strokes and the number of pressurized air bursts can be provided to the installer to achieve adequate cleaning of the hole and for quality assurance. The preformed end of the anchor is embedded using adhesive into the hole to the required depth. The free ends of the fibers/rovings are splayed onto the surfaces of the strengthened members or onto adjacent members and adhered with adhesives as required. A variety of splay configurations are possible as illustrated in the figures and each is intended to achieve a specific objective.

The connectors described above may be installed by first drilling or coring a hole of a predetermined diameter or shape through a structural member through which the connector is to be installed. The hole size and shape is a function of the size and shape of the connector. The hole may be cleaned by the use of a wire brush and pressurized air. The number of brush strokes and the number of pressured air bursts can be provided to the installer to achieve adequate cleaning of the hole and for quality assurance. One end of the connector may be provided with an installation aid. This end may be inserted into the hole and the connector pulled through the hole until the required length of the free ends of fibers/rovings are extended on each side of the structural member and the preformed midsection is within the width or thickness of the structural member. The free ends of the fibers/rovings are then splayed onto the surfaces of the strengthened members or onto adjacent members and adhered with adhesives as required. A variety of splay configurations are possible as illustrated in the figures and each is intended to achieve a specific objective.

The surface mounted reinforcement can be either preinstalled on to the surface of the structure or it may be installed after the anchors have been placed.

Figure 5A:
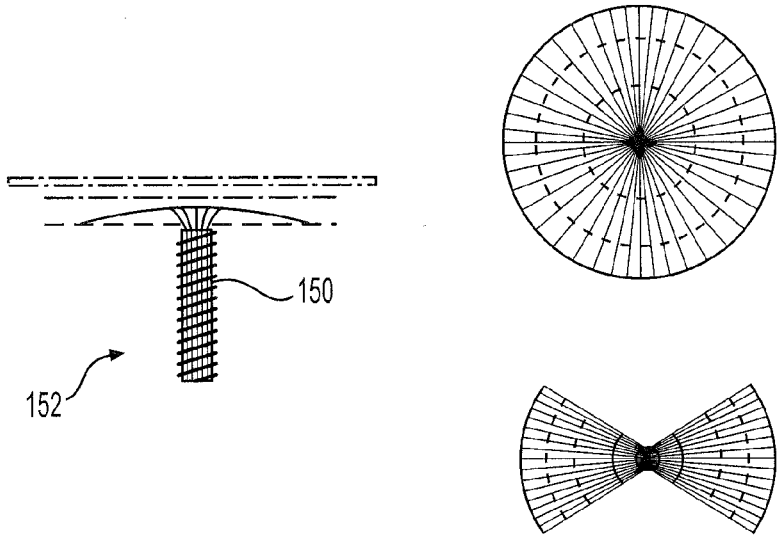
FIGS. 5A and 5B show diagrammatic representations of exemplary anchors in accordance with various aspects of the disclosure.

As shown in FIG. 5A, an exemplary anchor may have free fibers/rovings, which can be arranged in a variety of splay configurations in the field/site. In order to speed up installation, the splays can be pre-formed in either 360 degree, single fan or bow-tie configurations (the angle of the single fan or bow-tie could range from almost zero, for just a bundle of fibers/rovings, to 180 degrees to make the full circle). This preformed splay could either be pre-cured (i.e. saturated with adhesive and hardened) or flexible and held in shape with secondary stitching to permit the addition of adhesive in the field. Additionally, in some aspects, a pre-cured "patch plate" may be disposed over the splay. The patch plate could be pre-attached to the splay so that the anchor could be installed in one go with the patch plate on or the patch plate could be installed later. The patch plate can be a pre-cured piece of the desired dimensions formed either from a specific configuration of rovings or from FRP fabrics which are impregnated with an appropriate adhesive.

Figure 5B:
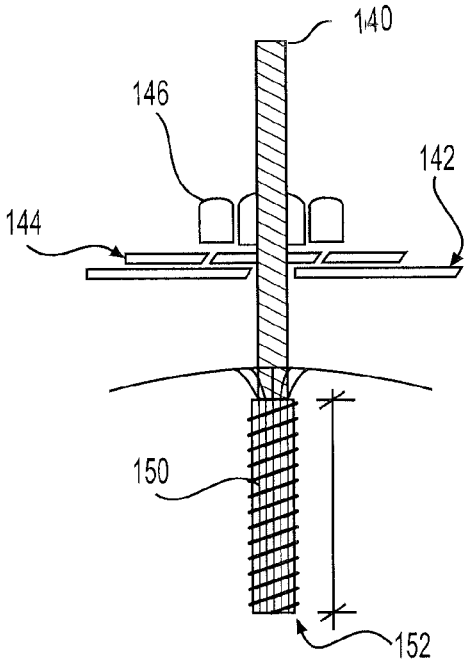

Referring now to FIG. 5B, an FRP anchor with a steel rod 140 is shown. In some cases, steel members such as equipment supports or other structural steel may need to be mounted over the strengthened member (i.e., over the surface-mounted reinforcement). To avoid a galvanic potential between steel and carbon (in the surface-mounted reinforcement or the anchor), glass fiber-reinforced polymer have been previously used in between as an insulator. However, this process can become quite difficult when a steel rod is needed for the anchorage. To address such applications, an exemplary FRP anchor may include a pre-embedded steel rod 140. Once the anchor is installed, not only will it anchor the surface-mounted reinforcement to the existing structural member, but it will also provide a steel threaded rod 140 for attaching any steel members. A fiber reinforced washer 142 and a steel washer 144 and nut 146 can be used to complete the connection. In some aspects, the splay can be preformed.

Figure 6A:
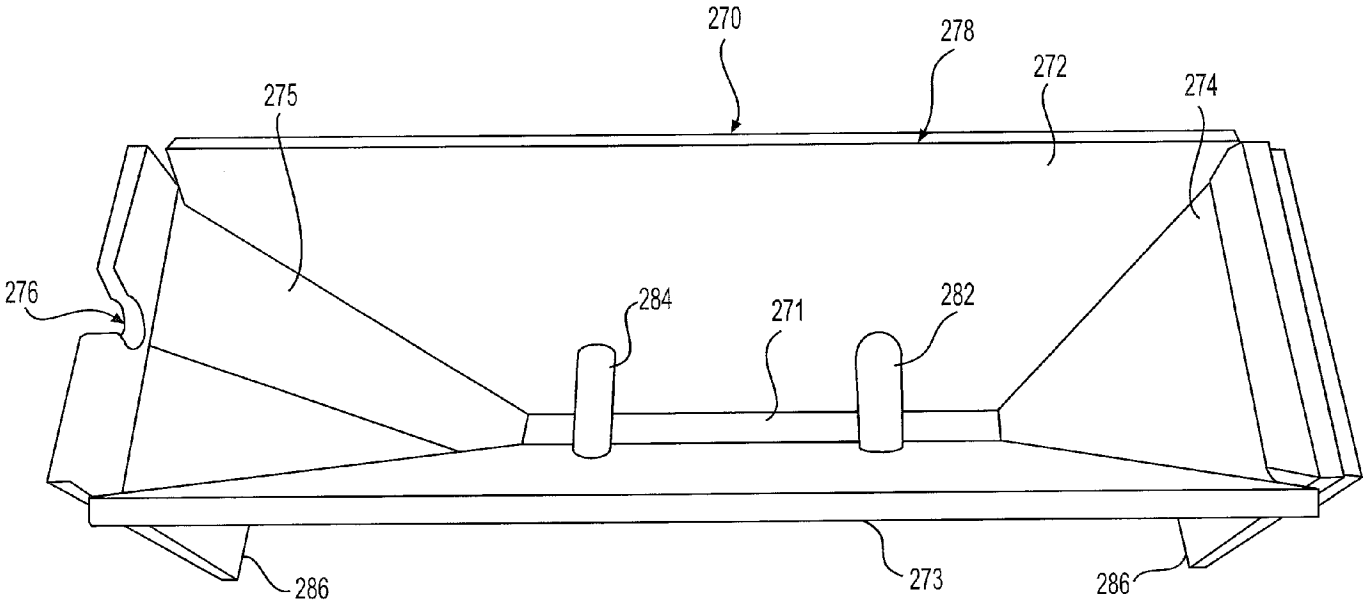
FIGS. 6A and 6B illustrate an exemplary tray for saturating connectors with an adhesive in accordance with various aspects of the disclosure.
Figure 6B:
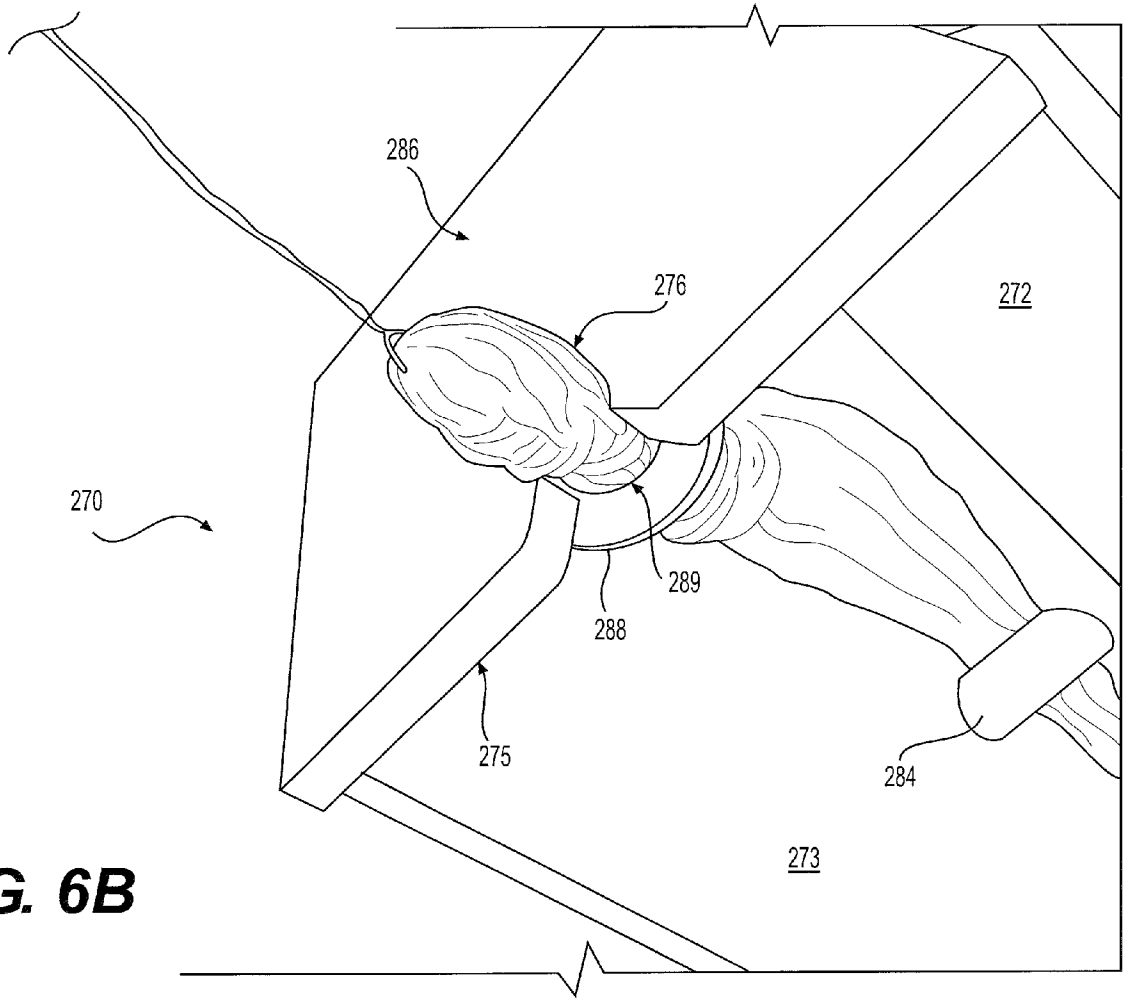

Referring now to FIGS. 6A & 6B, an exemplary tray 270 for use in saturating an anchor or connector (with or without a pre-cured portion) is disclosed. The tray 270 includes a bottom 271, a pair of opposite side walls 272, 273, and a pair of opposite end walls 274, 275. In some embodiments of the tray 270, the side walls 272, 273 and/or the end walls 274, 275 may be sloped relative to the bottom 272 such that the area of the bottom 271 is smaller than the area of a top opening 278 of the tray 270. The tray 270 includes two dowels 282, 284 extending from side wall 272 to side wall 273. The first dowel 282 is spaced further from the bottom 271 than the second dowel 284. The tray 270 may include one or more supports 286 for balancing the tray and keeping the tray steady during use. One or more of the supports 286 may form a portion of one or more of the side walls 272, 273 and/or end walls 274, 275. In one embodiment, end wall 275 includes a portion formed by a support 286, and the end wall 275 includes a cutout 276.

In use, the tray 270 is filled with an adhesive (not shown) to a level at or above the dowels 282, 284. An anchor or connector (with or without a pre-cured portion) is fed under the dowels 282, 284 in a direction from a first end wall 274 toward the second end wall 275. The spacing of the first dowel 282 from the bottom 271 is selected such that the fibers/rovings of the anchor/connector are permitted to open up to allow better saturation of the anchor/connector. The second dowel 284, being closer to the bottom 271, forces the fibers/rovings back closer together. The dowels 282, 284 force the anchor/connector into the adhesive. Without the dowels 282, 284, the anchor/connector would float on top of the adhesive bath.

As shown in FIG. 6B, after emerging from the second dowel 284 and the epoxy resin bath (not shown), a leading end of the anchor/connector is fed through a ring or tube 288 having an opening 289 sized to match the cross-section of the anchor/connector. The ring or tube 288 also has a peripheral size that exceeds the size of the cutout 276. The cutout 276 thus holds the ring or tube 288 as the anchor/connector is pulled through the ring or tube 288 so that excess epoxy resin is stripped off the anchor/connector and falls into the tray 270 for use with another anchor/connector. The sloped walls 272, 273, 274 275 help to feed the fibers/rovings of the anchor/connector and also result in a reduced volume tray 270 which reduces the amount of wasted epoxy resin when the saturation process is completed.

It will be apparent to those skilled in the art that various modifications and variations can be made to the anchors and connectors, methods of making anchors and connectors, and processes for reinforcing a structure of the present disclosure without departing from the scope of the invention. Throughout the disclosure, use of the terms "a," "an," and "the" may include one or more of the members to which they refer. Other embodiments of the invention will be apparent to those skilled in the art from consideration of the specification, as well as from the practice of the invention disclosed herein. It is intended that the specification and examples be considered as exemplary only.

What is claimed is:

1. A method of making a fiber-reinforced anchor or connector at a fabrication site that is remote from a field site where the anchor or connector will be installed, the method comprising:

bundling a predetermined amount of fibers/rovings having a desired length to a desired cross-sectional size and shape;

encapsulating a first portion of the bundle of fibers/rovings in an adhesive while leaving a second portion of the bundle unencapsulated; and pre-curing the encapsulated portion at the fabrication site to form a reinforced portion of the bundle before the anchor or connector reaches the field site, wherein a material is introduced in the adhesive, during or after the pre-curing, at the fabrication site to create a roughened texture or deformation along the reinforced portion of the bundle.

2. A method of anchoring surface mounted strengthening systems to a structural member being repaired/strengthened or connecting the surface mounted strengthening systems to adjacent structural members to provide force-transfer or terminating a surface-mounted strengthening system, the method comprising:

making a fiber-reinforced anchor or connector according to the method of claim 1;

drilling a hole in an existing structural member;

inserting the first portion of the pre-cured fiber-reinforced anchor or connector into the hole in the existing structural member, the reinforced portion having a desired cross-sectional size and shape to be received by the hole;

splaying free ends of the fibers/rovings at an end of the anchor; and adhering the splayed ends of the fibers/rovings onto the surface-mounted strengthening system of the strengthened member or onto adjacent members with adhesive.

3. The method of claim 2, further comprising, before the adhering step, installing a strengthening system to a surface of the existing structural member.

4. The method of claim 2, further comprising, before the adhering step, installing a strengthening system to surfaces of existing adjacent structural members.

5. The method of claim 2, wherein the step of inserting a first portion includes inserting an end portion of the fiber-reinforced anchor into the hole.

6. The method of claim 2, wherein the step of inserting a first portion includes inserting a middle portion of the fiber-reinforced polymer connector into the hole.

7. The method of claim 1, wherein the step of encapsulating a first portion includes encapsulating an end portion of the fiber-reinforced anchor.

8. The method of claim 1, wherein the step of encapsulating a first portion includes encapsulating a middle portion of the fiber-reinforced connector.

9. The method of claim 1, further comprising attaching a sheath to a free end of the bundled fibers/rovings.

10. A method of making a fiber-reinforced anchor or connector at a fabrication site that is remote from a field site where the anchor or connector will be installed, the method comprising:

bundling a predetermined amount of fibers/rovings having a desired length to a desired cross-sectional size and shape;

encapsulating a first portion of the bundle of fibers/rovings in an adhesive while leaving a second portion of the bundle unencapsulated;

introducing the encapsulated first portion into a forming piece or mold to create a roughened texture or deformation along the first portion of the bundle; and pre-curing the encapsulated portion at the fabrication site to form a reinforced portion of the bundle having the roughened texture or deformation before the anchor or connector reaches the field site.

11. The method of claim 10, wherein the step of encapsulating a first portion includes encapsulating an end portion of the fiber-reinforced anchor.

12. The method of claim 10, wherein the step of encapsulating a first portion includes encapsulating a middle portion of the fiber-reinforced connector.

13. The method of claim 10, further comprising attaching a sheath to a free end of the bundled fibers/rovings.

14. A method of making a fiber-reinforced anchor or connector, the method comprising:

bundling a predetermined amount of fibers/rovings having a desired length to a desired cross-sectional size and shape; and encapsulating the bundle of fibers/rovings in an adhesive, wherein the encapsulating step comprises:

providing a tray configured to hold a volume of liquid, the tray including at least one dowel spaced from a bottom of the tray and extending in a first direction from a first side wall of the tray to a second side wall of the tray; and feeding the bundle of fibers/rovings under the at least one dowel in a second direction from a first end wall of the tray to a second end wall of the tray, the second direction being orthogonal to the first direction.

15. The method of claim 14, wherein the feeding step comprises feeding the bundle of fibers/rovings along a surface of the first end wall that slopes from a top of the tray toward the bottom of the tray before feeding the bundle of fibers/rovings under the at least one dowel.

16. The method of claim 15, wherein the feeding step comprises, after feeding the bundle of fibers/rovings under the at least one dowel, feeding the bundle of fibers/rovings along a surface of the second end wall that inclines from the bottom of the tray toward the top of the tray.

17. The method of claim 14, wherein the at least one dowel comprises a first dowel and a second dowel, the first dowel being spaced further from the bottom of the tray than the second dowel.

18. The method of claim 17, wherein the feeding step comprises feeding the bundle of fibers/rovings under the first dowel before feeding the bundle of fibers/rovings under the second dowel.

19. The method of claim 14, further comprising, after feeding the bundle of fibers/rovings under the at least one dowel, feeding the bundle of fibers/rovings through a stripping member configured to remove excess liquid from the bundle of fibers/rovings.

20. The method of claim 19, further comprising, before feeding the bundle of fibers/rovings through the stripping member, engaging the stripping member with a cutout at the second end of the tray such that the stripping member is prevented from moving relative to the second end of the tray while allowing the bundle of fibers/rovings to be fed through the stripping member.

21. A method of anchoring surface mounted strengthening systems to a structural member being repaired/strengthened or connecting the surface mounted strengthening systems to adjacent structural members to provide force-transfer or terminating a surface-mounted strengthening system, the method comprising:

making a fiber-reinforced anchor or connector according to the method of claim 10;

drilling a hole in an existing structural member;

inserting a first portion of the pre-cured fiber-reinforced anchor or connector into the hole in the existing structural member, the reinforced portion having a desired cross-sectional size and shape to be received by the hole;

splaying free ends of the fibers/rovings at an end of the anchor; and adhering the splayed ends of the fibers/rovings onto the surface-mounted strengthening system of the strengthened member or onto adjacent members with adhesive.

22. The method of claim 21, further comprising, before the adhering step, installing a strengthening system to a surface of the existing structural member.

23. The method of claim 21, further comprising, before the adhering step, installing a strengthening system to surfaces of existing adjacent structural members.

24. The method of claim 21, wherein the step of inserting a first portion includes inserting an end portion of the fiber-reinforced anchor into the hole.

25. The method of claim 21, wherein the step of inserting a first portion includes inserting a middle portion of the fiber-reinforced polymer connector into the hole.

* * * * *